US006301880B1

(12) United States Patent
Cullen et al.

(10) Patent No.: US 6,301,880 B1
(45) Date of Patent: Oct. 16, 2001

(54) METHOD AND SYSTEM FOR CONTROLLING AIR/FUEL LEVEL FOR INTERNAL COMBUSTION ENGINE WITH TWO EXHAUST BANKS

(75) Inventors: Michael John Cullen, Northville; Brent Edward Sealy, Dearborn; Kenneth John Behr, Farmington Hills; Richard Andrew Booth, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,664

(22) Filed: Jan. 20, 2000

(51) Int. Cl.[7] ..... F01N 3/00
(52) U.S. Cl. ..... 60/274; 60/276; 60/285; 123/443
(58) Field of Search ..... 60/274, 276, 285, 60/277; 123/443

(56) References Cited

U.S. PATENT DOCUMENTS

| | | |
|---|---|---|
| 5,074,113 | 12/1991 | Matsuoka . |
| 5,207,057 | 5/1993 | Kayanuma . |
| 5,228,287 | 7/1993 | Kuronishi et al. . |
| 5,233,829 | 8/1993 | Komatsu . |
| 5,247,793 | 9/1993 | Yamada et al. . |
| 5,255,512 | 10/1993 | Hamburg et al. . |

(List continued on next page.)

OTHER PUBLICATIONS

U.S.P.A. for "Method And System For Compensating For Degraded Pre–Catalyst Oxygen Sensor In A Two–Bank Exhaust System" filed on the same date hereof; Inventors: Booth, et al.; Attorney Docket No. 198–0963 (65080–0005).

U.S.P.A. for "Method And System For Controlling Air/Fuel Level In Two–Bank Exhaust System" filed on the same date hereof; Inventors: Booth, et al.; Attorney Docket No. 199–1619 (65080–0006).

U.S.P.A. for "Method For Controlling Air/Fuel Mixture" filed on the same date hereof; Inventors: Booth, et al.; Attorney Docket No. 199–1803 (65080–0008).

U.S.P.A. for "Diagnostic System For Detecting Catalyst Failure Using Switch Ratio" filed on the same date hereof; Inventors: Booth, et al.; Attorney Docket No. 199–1788 (65080–0009).

U.S.P.A. for "Diagnostic System For Monitoring Catalyst Operation Using Arc Length Ratio" filed on the same date hereof; Inventors: Booth, et al.; Attorney Docket No. 199–1790 (65080–0010).

*Primary Examiner*—Thomas Denion
*Assistant Examiner*—Binh Tran
(74) *Attorney, Agent, or Firm*—John F. Buckert; Allan J. Lippa

(57) ABSTRACT

A method and system for controlling the air/fuel ratio in an internal combustion engine having first and second groups of cylinders coupled to first and second exhaust banks, respectively. The first exhaust bank includes a catalyst and at least a pre-catalyst oxygen sensor. The second exhaust bank includes a catalyst and no more than one post-catalyst oxygen sensor. The oxygen sensors monitor the oxygen content of the exhaust gases in their corresponding exhaust banks and provide feedback signals to a controller. The controller uses the feedback signal from the pre-catalyst oxygen sensor (in the first bank) to calculate desired A/F values in the first group of cylinders. The controller uses both the feedback signal from the pre-catalyst oxygen sensor (in the first bank) and the feedback signal from the post-catalyst oxygen sensor (in the second bank) to calculate desired A/F values for the second group of cylinders.

18 Claims, 4 Drawing Sheets

U.S. PATENT DOCUMENTS

| | | | | |
|---|---|---|---|---|
| 5,279,114 | | 1/1994 | Kurita et al. . | |
| 5,282,360 | | 2/1994 | Hamburg et al. . | |
| 5,351,484 | * | 10/1994 | Wade | 60/274 |
| 5,359,852 | | 11/1994 | Curran et al. . | |
| 5,377,484 | | 1/1995 | Shimizu . | |
| 5,394,691 | | 3/1995 | Seki . | |
| 5,417,058 | | 5/1995 | Shimizu . | |
| 5,450,837 | | 9/1995 | Uchikawa . | |
| 5,485,382 | | 1/1996 | Seki et al. . | |
| 5,511,377 | | 4/1996 | Kotwicki . | |
| 5,570,574 | | 11/1996 | Yamashita et al. . | |
| 5,704,339 | | 1/1998 | Choe et al. . | |
| 5,706,793 | | 1/1998 | Orzel et al. . | |
| 5,749,221 | | 5/1998 | Kawahira et al. . | |
| 5,894,727 | | 4/1999 | Zimlich . | |
| 5,899,062 | | 5/1999 | Jerger et al. . | |
| 6,047,542 | * | 4/2000 | Kinugasa et al. | 60/274 |
| 6,047,544 | * | 4/2000 | Yamamoto et al. | 60/285 |
| 6,112,731 | * | 9/2000 | Linenberg et al. | 60/276 |

* cited by examiner

METHOD AND SYSTEM FOR CONTROLLING AIR/FUEL LEVEL FOR INTERNAL COMBUSTION ENGINE WITH TWO EXHAUST BANKS

TECHNICAL FIELD OF THE INVENTION

The present invention relates generally to electronic control of an internal combustion engine having first and second groups of cylinders. In particular, this invention relates to a system and method of controlling the air/fuel ratio in the second group of cylinders based on a feedback signal received from an oxygen exhaust sensor located downstream of the second group of cylinders and a feedback signal from at least one exhaust gas oxygen sensor located downstream of the first group of cylinders.

BACKGROUND

To meet current emission regulations, automotive vehicles must regulate the air/fuel ratio (A/F) supplied to the vehicles' cylinders so as to achieve maximum efficiency of the vehicles' catalysts. For this purpose, it is known to control the air/fuel ratio of internal combustion engines using an exhaust gas oxygen (EGO) sensor positioned in the exhaust stream from the engine. The EGO sensor provides feedback data to an electronic controller that calculates preferred A/F values over time to achieve optimum efficiency of a catalyst in the exhaust system. It is also known to have systems with two EGO sensors in the exhaust stream in an effort to achieve more precise A/F control with respect to the catalyst window. Normally, a pre-catalyst EGO sensor is positioned upstream of the catalyst and a post-catalyst EGO sensor is positioned downstream of the catalyst. Finally, in connection with engines having two groups of cylinders, it is known to have a two-bank exhaust system coupled thereto where each exhaust bank has a catalyst as well as pre-catalyst and post-catalyst EGO sensors. Each of the exhaust banks corresponds to a group of cylinders in the engine. The feedback signals received from the EGO sensors are used to calculate the desired A/F values in their respective group of cylinders at any given time. The controller uses these desired A/F values to control the amount of liquid fuel that is injected into the cylinders by the vehicle's fuel injector. It is a known methodology to use the EGO sensor feedback signals to calculate desired A/F values that collectively, when viewed over time, form A/F waveforms having ramp portions, jumpback portions and hold portions, as shown in FIG. 4.

In order to build two-bank exhaust systems more economically, it is known to eliminate one of the post-catalyst EGO sensors in a two-bank, four-EGO sensor system. Specifically, it is known to eliminate the post-catalyst EGO sensor in one of the banks and move the post-catalyst EGO sensor from the other bank downstream in the system to where the exhaust gases from the two banks are combined prior to being expelled from the system. This system is known as the so-called Y-pipe system and is shown generally in FIG. 2. In the Y-pipe system, the single downstream EGO sensor performs the function of monitoring the oxygen content of the post-catalyst exhaust gases for both banks. However, because the exhaust gases from the two banks are combined prior to reaching the downstream EGO sensor, the data provided from the downstream EGO sensor is derived from the mixture of the exhaust gases from the two banks. Thus, because the downstream EGO sensor is unable to distinguish between the oxygen contents of the separate banks, the feedback data provided by the downstream EGO sensor is not specific to either bank. Accordingly, the A/F levels for the individual banks cannot be monitored and controlled as closely, and, as a result, the potential performance of the system is limited.

Therefore, it is desirable to have an improved system and methodology for controlling the A/F levels in each exhaust bank of a two-bank system using only three EGO sensors.

SUMMARY OF THE INVENTION

The present invention is directed toward a new system and methodology for adjusting the A/F level in an internal combustion engine coupled to a two-bank exhaust system using only three EGO sensors. Specifically, the system includes a first and a second exhaust bank with each bank including a catalyst. Each exhaust bank corresponds to a respective group of cylinders in the engine. The first exhaust bank includes a pre-catalyst EGO sensor and a post-catalyst EGO sensor. The second exhaust bank includes only a post-catalyst EGO sensor. The system operates generally by calculating A/F values for the group of cylinders corresponding to the first bank using feedback signals from both its pre-catalyst and its post-catalyst EGO sensors. These calculated A/F values together form an A/F waveform over time. An electronic controller, in cooperation with a fuel injector, uses this A/F waveform to control the A/F levels in the group of cylinders corresponding to the first exhaust bank. The controller also calculates A/F values for the group of cylinders corresponding to the second bank based on feedback signals from the EGO sensors in the first bank and the EGO sensor in the second bank. Specifically, the system uses the A/F waveform calculated for the first bank as the A/F waveform for the second bank, except that a portion of the second bank A/F waveform is modified based on the feedback signal from the second bank's post-catalyst EGO sensor.

In particular, the controller uses well-known methodologies to calculate a desired A/F waveform for the first bank that has ramp portions, jumpback portions and hold portions, as shown in FIG. 4. Then, the controller uses the feedback signal provided by the second bank's post-catalyst EGO sensor to modify the hold portions of the A/F waveform calculated for the first bank to generate an A/F waveform for the second bank, as shown in FIG. 5. Thus, the A/F waveform for the second bank has A/F ramp portions and A/F jumpback portions that are identical to the A/F ramp portions and A/F jumpback portions of the first bank. However, the A/F values for the hold portions of the second bank are modified based on the feedback signal provided by the second bank's post-catalyst EGO sensor. This system and methodology provides more responsive A/F values, and, as a result, permits both catalysts to operate more efficiently compared to the known so-called Y-pipe system.

DETAILED DESCRIPTION OF THE PREFERRED EMBODIMENT

Figure 1:
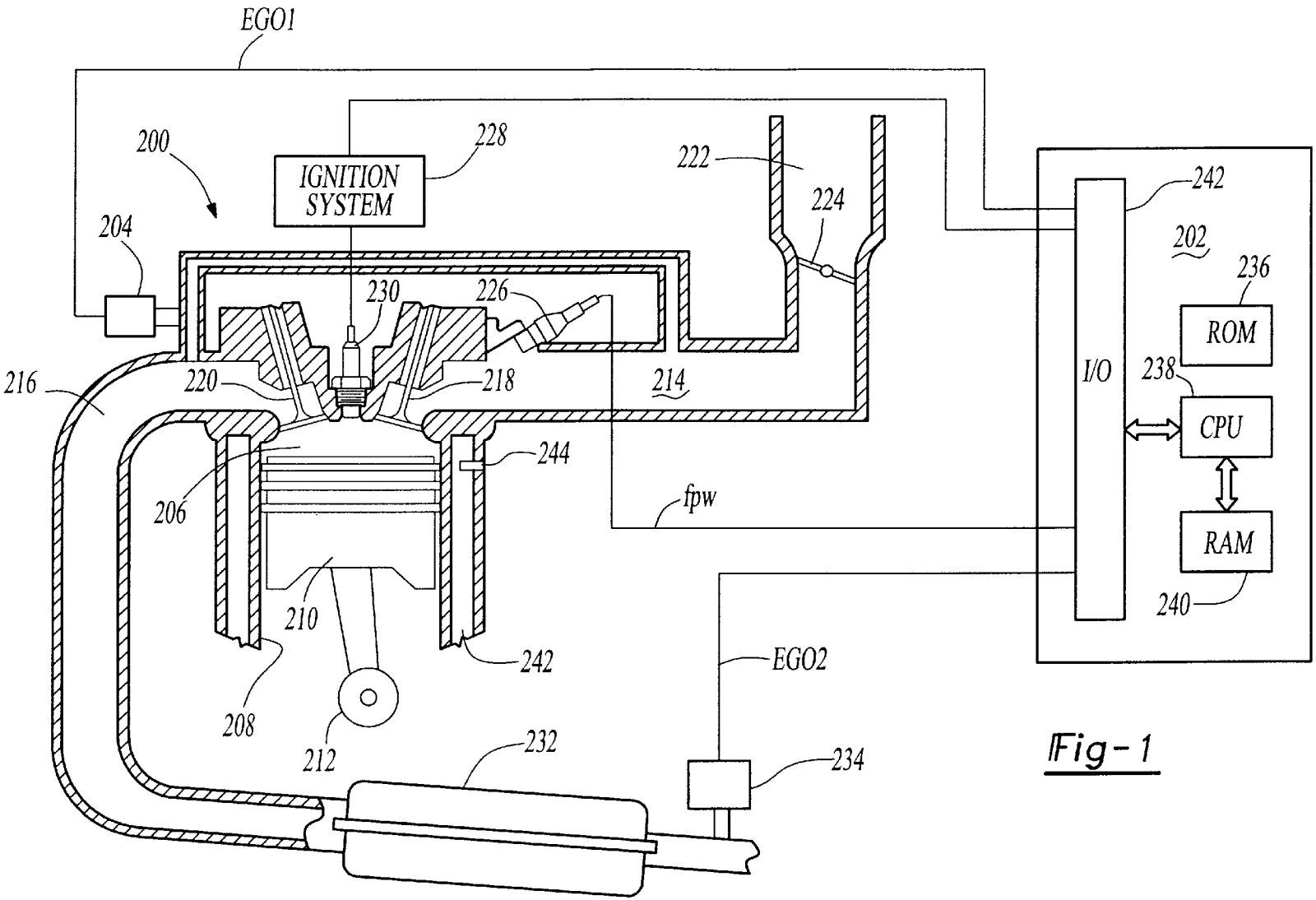
FIG. 1 illustrates an internal combustion engine, according to a preferred embodiment of the invention.
Figure 2:
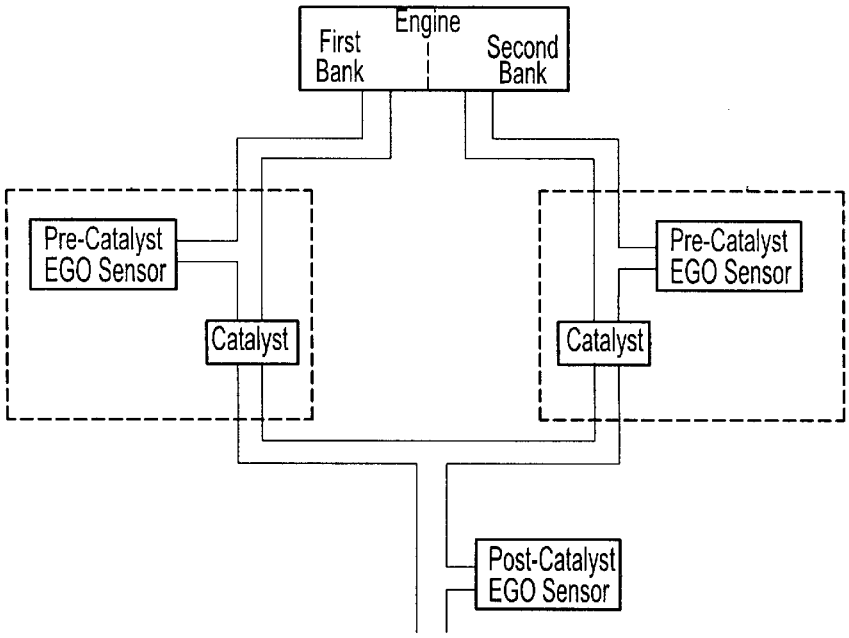
Fig-2 PRIOR ART
FIG. 2 shows a schematic representation of a known two-bank Y-pipe exhaust system.

FIG. 1 illustrates an internal combustion engine. Engine 200 generally comprises a plurality of cylinders, but, for illustration purposes, only one cylinder is shown in FIG. 1. Engine 200 includes combustion chamber 206 and cylinder walls 208 with piston 210 positioned therein and connected to crankshaft 212. Combustion chamber 206 is shown communicating with intake manifold 214 and exhaust manifold 216 via respective intake valve 218 and exhaust valve 220. As described later herein, engine 200 may include multiple exhaust manifolds with each exhaust manifold corresponding to a group of engine cylinders. Intake manifold 214 is also shown having fuel injector 226 coupled thereto for delivering liquid fuel in proportion to the pulse width of signal FPW from controller 202. Fuel is delivered to fuel injector 226 by a conventional fuel system (not shown) including a fuel tank, fuel pump, and fuel rail (not shown).

Conventional distributorless ignition system 228 provides ignition spark to combustion chamber 206 via spark plug 230 in response to controller 202. Two-state EGO sensor 204 is shown coupled to exhaust manifold 216 upstream of catalyst 232. Two-state EGO sensor 234 is shown coupled to exhaust manifold 216 downstream of catalyst 232. EGO sensor 204 provides a feedback signal EGO1 to controller 202 which converts signal EGO1 into two-state signal EGOS1. A high voltage state of signal EGOS1 indicates exhaust gases are rich of a reference A/F and a low voltage state of converted signal EGO1 indicates exhaust gases are lean of the reference A/F. EGO sensor 234 provides signal EGO2 to controller 202 which converts signal EGO2 into two-state signal EGOS2. A high voltage state of signal EGOS2 indicates exhaust gases are rich of a reference air/fuel ratio and a low voltage state of converted signal EGO1 indicates exhaust gases are lean of the reference A/F. Controller 202 is shown in FIG. 1 as a conventional microcomputer including: microprocessor unit 238, input/output ports 242, read only memory 236, random access memory 240, and a conventional data bus.

Figure 3:
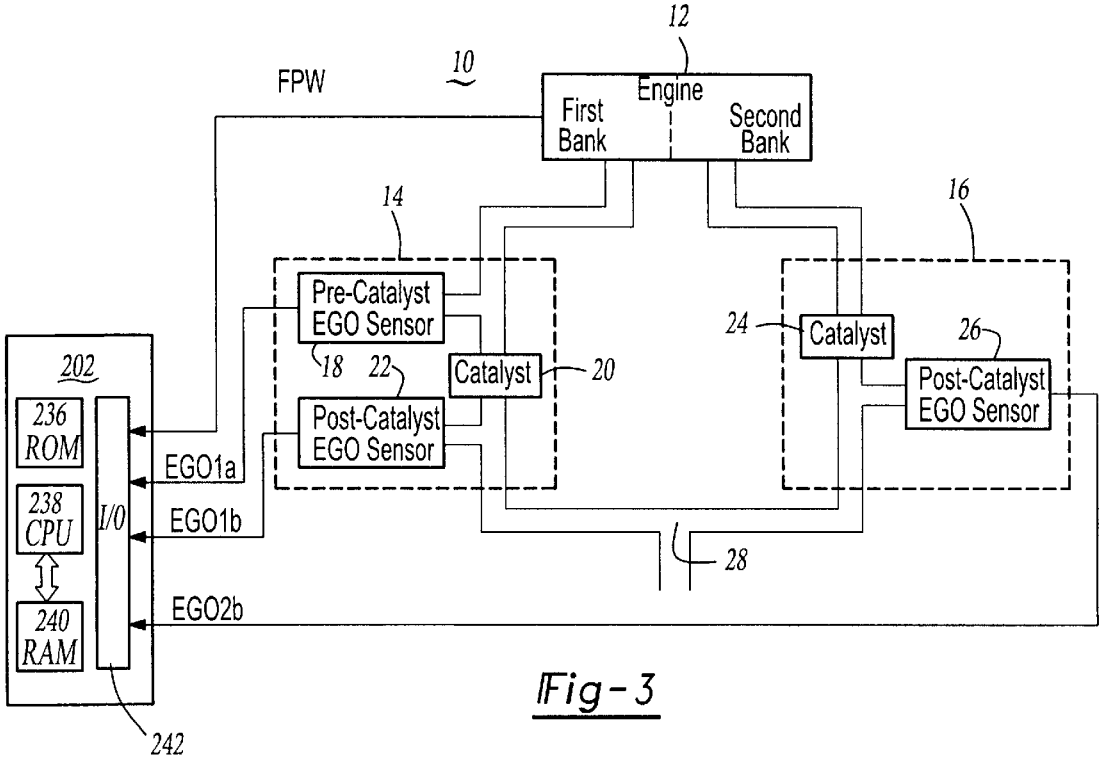
FIG. 3 shows a schematic representation of a two-bank exhaust system according to a preferred embodiment of the present invention.

FIG. 3 schematically illustrates a preferred embodiment of the two-bank exhaust system of the present invention. As shown in FIG. 3, exhaust gases flow from first and second groups of cylinders of engine 12 through a corresponding first exhaust bank 14 and second exhaust bank 16. Engine 12 is the same as or similar to engine 200 in FIG. 1. Exhaust bank 14 includes pre-catalyst EGO sensor 18, catalyst 20, and post-catalyst EGO sensor 22. Exhaust bank 16 includes catalyst 24 and post-catalyst EGO sensor 26. The pre-catalyst EGO sensors, catalysts, and post-catalyst EGO sensors in FIG. 3 are the same as or similar to pre-catalyst EGO sensor 204, catalyst 232, and post-catalyst EGO sensor 234 in FIG. 1.

In operation, when exhaust gases flow from engine 12 through exhaust bank 14, the pre-catalyst EGO sensor 18 senses the level of oxygen in the exhaust gases passing through bank 14 prior to them entering catalyst 20 and provides feedback signal EGO1*a* to controller 202. After the exhaust gases pass through catalyst 20, the post-catalyst EGO sensor 22 senses the level of oxygen in the exhaust gases subsequent to exiting catalyst 20 and provides feedback signal EGO1*b* to controller 202. With respect to exhaust bank 16, gases flow from the engine 12 through catalyst 24. Subsequent to exiting catalyst 24, post-catalyst EGO sensor 26 senses the level of oxygen in the post-catalyst exhaust gases in bank 16 and provides feedback signal EGO2*b* to controller 202. Then the exhaust gases are joined at junction 28 before being expelled from the system 10, though the disclosed invention is equally applicable to a system wherein the exhaust banks are maintained separate throughout the entire system. Controller 202 used feedback signals EGO1*a*, EGO1*b*, and EGO2*b*, to calculate preferred A/F values and, in connector with fuel injector 226 (FIG. 1), uses these values to control the amount of liquid fuel that is introduced into the groups of cylinders. The controller shown in FIG. 3 is the same as or similar to controller 202 in FIG. 1.

Figure 4:
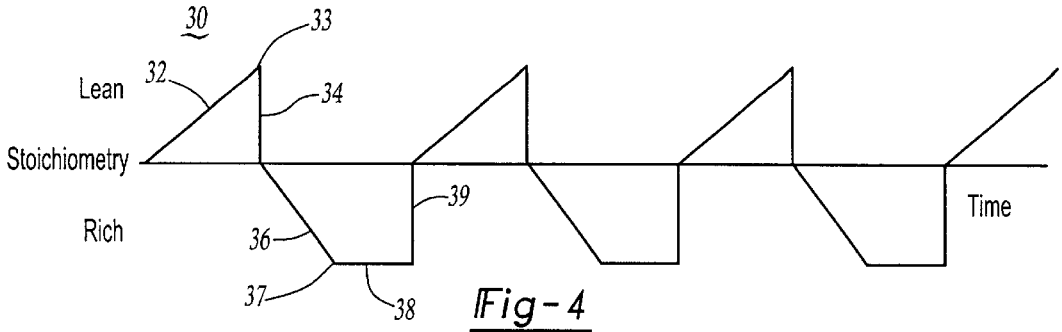
FIG. 4 shows a preferred A/F waveform corresponding to a group of cylinders coupled to an exhaust bank having both a pre-catalyst and a post-catalyst EGO sensor, according to a preferred embodiment of the invention.

Generally, to achieve the most efficient operation of the catalysts, it is desirable to oscillate the A/F in a group of cylinders around stoichiometry so that the A/F is sometimes rich and sometimes lean relative to stoichiometry. As is well-known in the art, the A/F in a group of cylinders can be controlled by varying the rich and lean A/F levels and the amount of time during which those rich and lean levels are held. FIG. 4 illustrates a typical preferred A/F waveform 30 over time that shows A/F levels being held at rich and lean levels for certain lengths of time to control the A/F level in a group of engine cylinders coupled to two properly-functioning EGO sensors. This A/F waveform 30 represents the desired A/F waveform used to control the A/F level in the group of cylinders corresponding to exhaust bank 14 of FIG. 3. Methodologies for calculating the A/F values that form such a waveform based on the feedback signals from pre-catalyst and post-catalyst EGO sensors are well-known in the art and are described in more detail in U.S. Pat. No. 5,282,360 and U.S. Pat. No. 5,255,512, for example. While the A/F waveform 30 shown in FIG. 4 is a preferred A/F waveform for exhaust bank 14, the disclosed invention also is applicable to other A/F waveforms that may be used.

As can be seen from the preferred A/F waveform in FIG. 4, the desired A/F level steadily rises over time, becoming more and more lean, until the EGO sensors detect a lean A/F state in the exhaust. This portion of the A/F waveform is referred to as a ramp portion 32 because the A/F level is being ramped up during this time period. After the EGO sensors detect that the A/F has reached a particular lean threshold value, the A/F is abruptly dropped toward or past stoichiometry. In the preferred embodiments of the invention, the A/F is dropped to a level approximately equal to stoichiometry. This portion of the waveform is referred to as a jumpback portion 34 because of the abrupt return of the A/F toward stoichiometry. Then, the A/F steadily decreases, becoming more and more rich, until the A/F reaches a particular rich threshold value. Similar to when the A/F steadily increases, this portion of the waveform is referred to as a ramp portion 36. Finally, after the EGO sensors detect that the A/F has decreased to a rich A/F state, the A/F is jumped to and held at a particular A/F level that delivers a desired level of rich bias. This portion of the A/F waveform is referred to as a hold portion 38. After the hold portion, the A/F level jumps back 39 toward stoichiometry, and the process is repeated. The A/F waveform 30 depicted in FIG. 4 is typical of a preferred waveform for a group of cylinders coupled to an exhaust bank having two EGO sensors, like bank 14 of FIG. 3. Controller 202 calculates the desired A/F ramp slope, the jumpback values, and the hold values based on feedback signals EGO1*a*, and EGO1*b*, received from EGO sensors 18 and 22, respectively.

With respect to the group of cylinders coupled to exhaust bank 16, the known methodologies for calculating preferred A/F values are not applicable because they depend upon receiving and utilizing a feedback signal from a pre-catalyst EGO sensor. However, exhaust bank 16 does not have a pre-catalyst EGO sensor. Thus, according to a preferred embodiment of the invention, the A/F values for the group of cylinders corresponding to bank 16 are calculated by using the A/F values generated for bank 14 (using well-known methodologies) and modifying some of them according to feedback signal EGO2*b*, received from post-catalyst EGO sensor 26. In particular, A/F waveform 40 corresponding to bank 16 utilizes the same ramp portion 32 as that calculated for bank 14. That is, the A/F values for the ramp portions 42, 44 corresponding to bank 16 are copied from the A/F values for the ramp portion 32, 36 corresponding to bank 14. Similarly, the A/F values for the jumpback portions 43, 46 corresponding to bank 16 are copied from the calculated jumpback portions 34, 39 corresponding to bank 14. However, the hold portion 45 corresponding to bank 16 is calculated based on feedback signal EGO2*b*, from post-catalyst EGO sensor 26. Feedback signal EGO2*b*, is used to modify the hold portion 38 corresponding to bank 14 to generate a hold portion 45 corresponding to bank 16.

Specifically, the A/F value corresponding to the hold portion 45 is generated by adjusting the A/F value corresponding to the hold portion 38 either lean or rich, depending upon feedback signal EGO2*b*. If feedback signal EGO2*b*, indicates that the A/F level is too rich in bank 28, then the A/F level during the hold portion is adjusted in the lean direction, as shown at 45 in FIG. 5. In some such cases, the A/F adjustment will be large enough so that the A/F level during the hold portion passes stoichiometry and is set to a lean bias, as shown at 48 in FIG. 5. If, on the other hand, feedback signal EGO2B indicates that the A/F level is too lean in bank 28, then the A/F level during the hold portion is adjusted in the rich direction, as shown at 47 in FIG. 5. The amount of adjustment either in the lean or rich direction, referred to as the total A/F bias, is determined by controller 202 based on feedback signal EGO2*b*. Controller 202 uses the calculated A/F values to control the A/F in the engine via signal FPW to fuel injector 226, as shown in FIG. 1 and as is well-known in the art.

Figure 6:
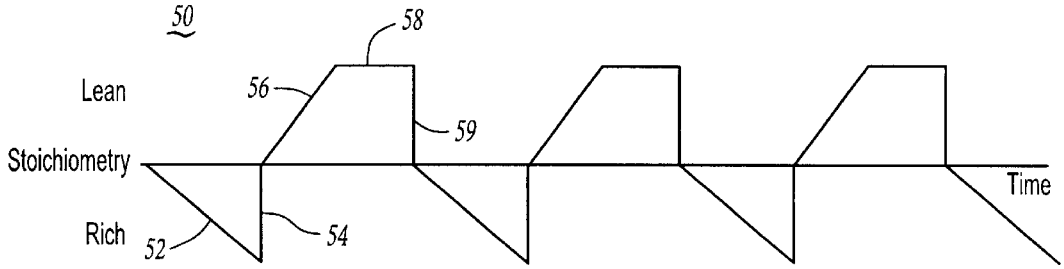
FIG. 6 shows a preferred A/F waveform corresponding to a group of cylinders coupled to an exhaust bank having both a pre-catalyst and a post-catalyst EGO sensor, according to an alternative embodiment of the invention.
Figure 7:
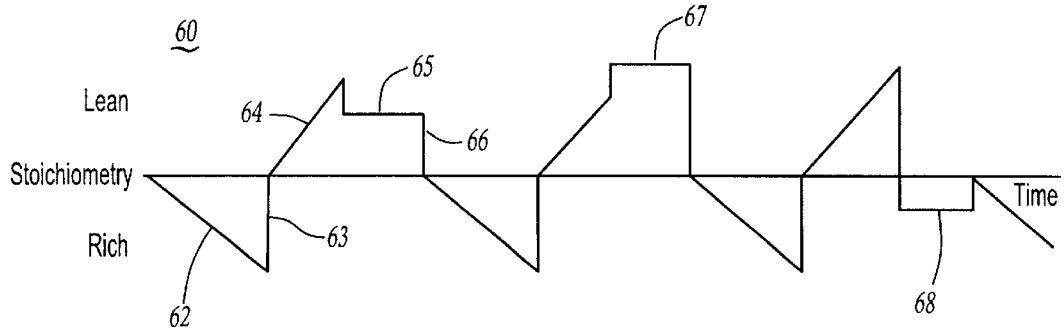
FIG. 7 shows an A/F waveform corresponding to a group of cylinders coupled to an exhaust bank having just a post-catalyst EGO sensor, according to an alternative embodiment of the present invention.

FIG. 6 and FIG. 7 illustrate an alternative embodiment of the disclosed invention. FIG. 6 shows an alternative A/F waveform 50 that can be used to control the A/F and oscillate the A/F around stoichiometry. The A/F values that comprise A/F waveform 50 shown in FIG. 6, like those that comprise A/F waveform 30, are generated by control module 202 based on feedback signals received from both a pre-catalyst EGO sensor and a post-catalyst EGO sensor using methods that are well-known in the art. The material difference between the waveform 30 in FIG. 4 and the waveform 50 in FIG. 6 is that the hold portion 58 in waveform 50 occurs on the lean side of stoichiometry as opposed to the rich side as in waveform 30. Like waveform 30, waveform 50 includes a ramp portion 52, a jumpback portion 54, a ramp portion 56, a hold portion 58, and a jumpback portion 59.

FIG. 6 illustrates a calculated waveform 60 for exhaust bank 28 according to the present invention when exhaust bank 14 utilizes a waveform 50 to control the A/F in the group of cylinders coupled to exhaust bank 14. As explained in more detail hereinabove, the ramp portions 52, 56 and the jumpback portions 54, 59 of waveform 50 are copied and used as the ramp portions 62, 64 and jumpback portions 63, 66 in waveform 60. Then, the hold portions 65, 67, 68 are calculated for waveform 60 based on feedback signal EGO2*b*, received from post-catalyst EGO sensor 26.

Figure 5:
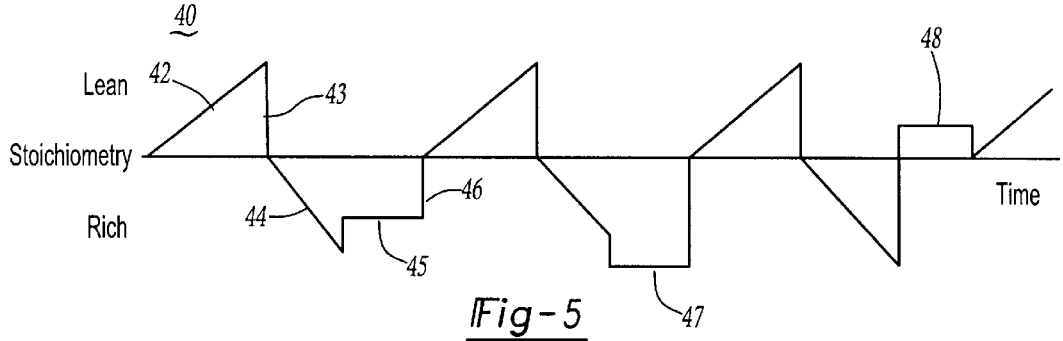
FIG. 5 shows an A/F waveform corresponding to a group of cylinders coupled to an exhaust bank having just a post-catalyst EGO sensor, according to a preferred embodiment of the invention.
Figure 8:
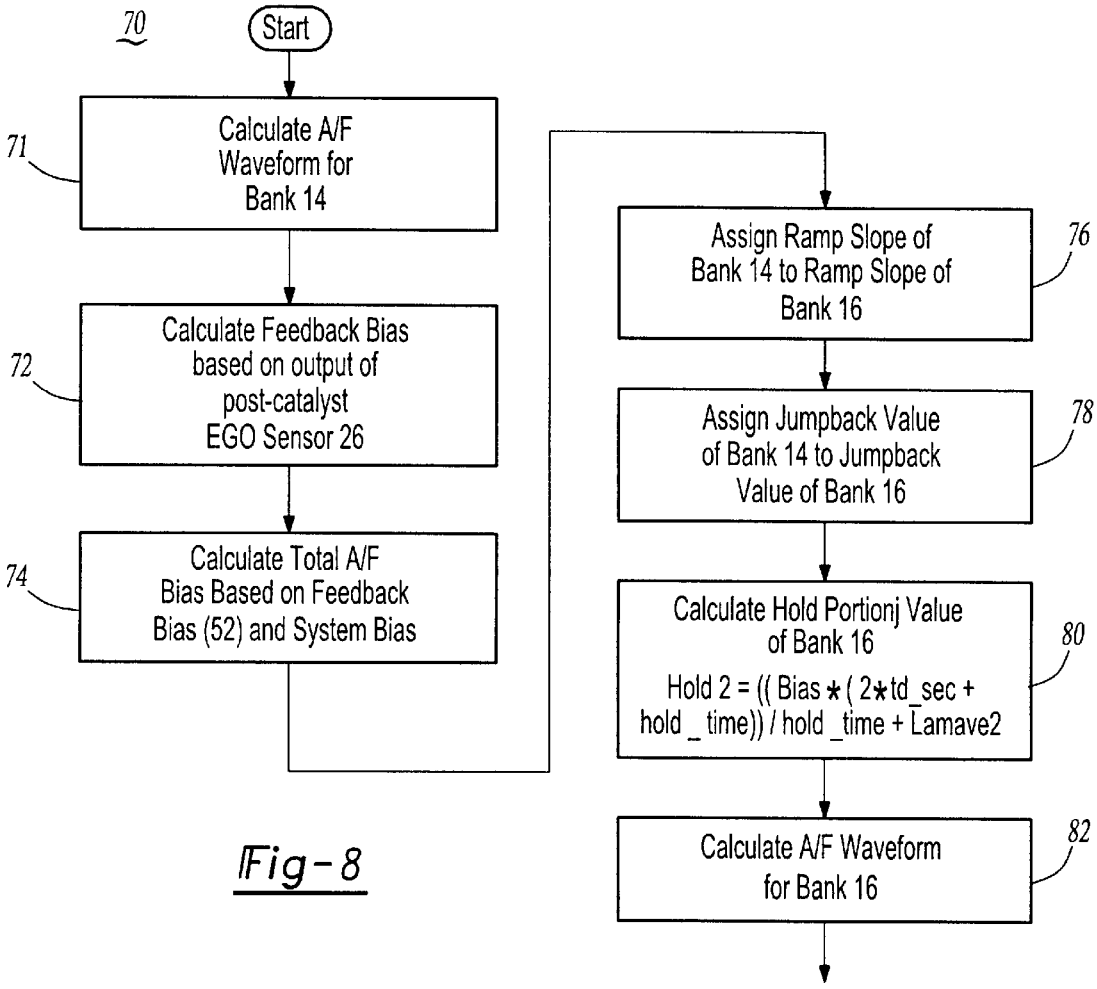
FIG. 8 is a flow-chart of the methodology used to calculate an A/F waveform corresponding to an exhaust bank having just a post-catalyst EGO sensor.

Referring again to the A/F waveforms shown in FIGS. 4 and 5, the specific methodology for calculating the slope of the A/F ramp portion 42, the A/F jumpback value 44 and the A/F hold value 48 for exhaust bank 16, according to a preferred embodiment of the invention, is illustrated in FIG. 8 and described as follows. First, the slope of the ramp portions 32, 36, the A/F jumpback value 34, and the A/F hold value 38 of waveform 30 (determined for the group of cylinders corresponding to bank 14) are calculated, as shown at step 71. These values are calculated according to well-known methodologies. Next, a feedback bias value for bank 16, referred to as RBIAS2, is calculated based on the feedback signal EGO2*b*, as shown in step 72. In the preferred embodiment of the invention, RBIAS2 is the sum of a proportional feedback bias term and an integral feedback bias term, as is known in the art.

After RBIAS2 is calculated, it is used to calculate the total desired deviation from stoichiometric A/F for the hold portion of bank 16, referred to as the total A/F bias (BIAS2), as shown in Step 74. BIAS2 is calculated by adding RBIAS2 to a state-of-the-system bias value. The state-of-the-system bias value is determined as a function of engine speed and engine load, as is known in the art.

Finally, the values necessary to determine the desired waveform 40 for bank 16 are determined. Specifically, the slope of ramps 42, 44 for bank 16, the jumpback value 43 of bank 16, and the hold value 45 of bank 16 are calculated. In step 76, the desired slope of ramp portion 42 (for bank 16) is equated with the calculated slope of ramp 32 (for bank 14). In step 78, the desired jumpback value 43 (for bank 16) is equated with the calculated jumpback value 34 (for bank 14). Then, the hold value 45 (for bank 16), referred to as HOLD2, is calculated, as shown in step 80, according to the following formula:

$$HOLD2=((BIAS2*(2*td_sec+hold_time))/hold_time)+lamave2$$

where td_sec is a known variable representing the transport delay time of the system and hold_time is a known variable representing the width of the A/F waveforms 30, 40 during the hold portions 38, 45. The variable, lamave2, represents the average A/F level in bank 14 at the previous two EGO switches. For example, when calculating the hold value 45 for bank 16, lamave2 represents the average of the A/F level in bank 14 at point 33 and point 37 of FIG. 4, which corresponds to the times when the waveform 30 transitions from (i) a ramp portion 32 to a jumpback portion 34, and (ii) a ramp portion 36 to a hold portion 38. Lastly, a waveform 40 is determined using the calculated ramp slope, jumpback value and hold value for the group of cylinders corresponding to bank 16, as shown in step 82. The calculations described above and the determination of the waveforms 30, 40 are accomplished by controller 202. The A/F values that comprise the waveforms are used by controller 202 to control the amount of liquid fuel introduced into the engine cylinders, as is known in the art.

The present invention has been described throughout in terms of a two-bank three-EGO sensor exhaust system.

However, it is contemplated that this invention could also be used in connection with a well-known two-bank four-EGO sensor exhaust system for purposes of compensating for a degraded post-catalyst EGO sensor in one of the banks. In such a system, well-known methodologies would be used to calculate the desired A/F waveforms for the respective banks while all four EGO sensors were operating properly. In the event that one of the pre-catalyst EGO sensors degraded, the invention described herein could be used to compensate for the degraded EGO sensor.

It should also be recognized that the present invention can be used in connection with a two-bank exhaust system similar to that shown in FIG. 3, but where the bank 14 only has a pre-catalyst EGO sensor 18. That is, the present invention is applicable to two-bank exhaust systems that have (i) a first exhaust bank having a catalyst and a pre-catalyst EGO sensor, and (ii) a second exhaust bank having a catalyst and a post-catalyst EGO sensor. In such systems, well-known methodologies are used to control the A/F levels in the first group of cylinders based on a feedback signal from only a single pre-catalyst EGO sensor. A/F values for the second group of cylinders are calculated by modifying the A/F values for the first group of cylinders based on a feedback signal from the post-catalyst EGO sensor in the second bank, according to the present invention.

While preferred embodiments of the present invention have been described herein, it is apparent that the basic construction can be altered to provide other embodiments which utilize the processes and compositions of this invention. Therefore, it will be appreciated that the scope of this invention is to be defined by the claims appended hereto rather than by the specific embodiments which have been presented hereinbefore by way of example.

What is claimed is:

1. An exhaust system having first and second exhaust banks coupled to an internal combustion engine, comprising:

a first catalyst connected in the first exhaust bank and a second catalyst connected in the second exhaust bank;

a pre-catalyst EGO sensor connected in the first exhaust bank between the engine and said first catalyst; and no more than one EGO sensor connected in the second exhaust bank, said second bank EGO sensor being connected downstream of said second catalyst.

2. The exhaust system in claim 1, further comprising a controller logically connected to the engine for controlling an injection of liquid fuel in the engine based on feedback signals from said second bank EGO sensor and said first bank pre-catalyst EGO sensor.

3. The exhaust system in claim 2, further comprising a post-catalyst EGO sensor connected in the first exhaust bank downstream of said first catalyst and in communication with said controller.

4. The exhaust system in claim 1, further comprising a post-catalyst EGO sensor connected in the first exhaust bank downstream of said first catalyst.

5. A method for controlling fuel injection in an engine having a first group of cylinders and a second group of cylinders coupled to a first catalyst and a second catalyst respectively, the method comprising:

generating a first feedback signal from a first EGO sensor located upstream of the first catalyst;

generating a second feedback signal from a second EGO sensor located downstream of the second catalyst; and adjusting a fuel injection amount into the second group of cylinders based on said first feedback signal and said second feedback signal.

6. The method of claim 5, further comprising the step of generating a first A/F waveform corresponding to the first group of cylinders based on said first feedback signal, and wherein said step of adjusting a fuel injection amount comprises the step of generating a second A/F waveform corresponding to the second group of cylinders.

7. The method of claim 6, wherein said step of generating a second A/F waveform comprises the steps:

duplicating portions of said first A/F waveform to use as corresponding portions of said second A/F waveform; and generating a portion of said second bank A/F waveform based on said second feedback signal.

8. The method of claim 7, wherein said step of generating a first A/F waveform comprises the steps:

generating a first A/F ramp slope corresponding to the first group of cylinders;

generating a first A/F jumpback value corresponding to the first group of cylinders; and generating a first A/F hold value corresponding to the first group of cylinders.

9. The method of claim 8, wherein said step of duplicating portions of said first bank A/F waveform comprises the steps:

duplicating said first A/F ramp slope; and duplicating said first A/F jumpback value.

10. The method of claim 9, wherein said step of generating a portion of said second A/F waveform based on said second feedback signal comprises the step of generating a second A/F hold value based on said second feedback signal.

11. The method of claim 10, wherein said step of generating a second A/F hold value comprises selectively adjusting said first A/F hold value based on said second feedback signal.

12. The method of claim 11, wherein said step of calculating a second A/F hold value comprises the steps:

calculating a total A/F bias corresponding to the second bank; and calculating an A/F hold value based on said total A/F bias for the second bank and a hold time variable.

13. The method of claim 12, wherein the step of calculating an A/F hold value based on said total A/F bias corresponding to the second bank and a hold time variable further comprises calculating said A/F hold value based on a variable representing a transport delay time.

14. The method of claim 13, wherein the step of calculating an A/F hold value based on said total A/F bias corresponding to the second bank and a hold time variable further comprises calculating said A/F hold value based on the average of the A/F level in the first bank at the previous two EGO switches.

15. The method of claim 5, further comprising the steps:

generating a third feedback signal from a third EGO sensor located downstream of the first catalyst; and controlling a fuel injection amount into the first group of cylinders based on said first feedback signal and said third feedback signal.

16. A control system for controlling fuel injection in an engine having a first group of cylinders and a second group of cylinders coupled to a first catalyst and a second catalyst respectively, comprising:

a first EGO sensor located upstream of the first catalyst for generating a first feedback signal;

a second EGO sensor located downstream of the second catalyst for generating a second feedback signal; and a controller coupled to the engine and said first and second EGO sensors for adjusting a fuel injection amount into the second group of cylinders based on said first feedback signal and said second feedback signal.

17. An exhaust system coupled to an internal combustion engine having first and second cylinder groups, comprising:

first and second catalysts communicating with exhaust gases from said first and second cylinder groups, respectively;

a first exhaust gas sensor connected between said engine and said first catalyst communicating with exhaust gases from said first cylinder group; and, no more than one exhaust gas sensor communicating with exhaust gases from said second cylinder group, said one exhaust gas sensor connected downstream of said second catalyst.

18. A method for controlling fuel injection in an engine having first and second cylinder groups coupled to first and second catalysts, respectively, the method comprising:

generating a first feedback signal from a first exhaust gas sensor located upstream of the first catalyst;

generating a second feedback signal from a second exhaust gas sensor located downstream of the second catalyst; and adjusting a fuel injection amount into the second group of cylinders based on said first feedback signal and said second feedback signal.

* * * * *